United States Patent [19]

Gorski et al.

[11] Patent Number: 4,873,021

[45] Date of Patent: Oct. 10, 1989

[54] AZEOTROPE OR AZEOTROPE-LIKE COMPOSITION OF TRICHLOROTRIFLUOROETHANE AND DICHLORODIFLUOROETHANE

[75] Inventors: Robert A. Gorski, Newark; Bernhardt J. Eiseman, Jr., late of Wilmington, both of Del., by Carol E. Aronoff, executrix; Donovan E. Kvalnes, late of Castine, Mass., by Atherton Fuller, personal representative

[73] Assignee: E. I. Du Pont de Nemours and Company, Wilmington, Del.

[21] Appl. No.: 947,834

[22] Filed: Dec. 30, 1986

[51] Int. Cl.[4] ..... C11D 7/50; B01F 1/00; C23G 5/028

[52] U.S. Cl. ..... 252/364; 252/172; 252/DIG. 9; 134/40; 134/42

[58] Field of Search ..... 252/364, 172, DIG. 9; 134/40, 42

[56] References Cited

U.S. PATENT DOCUMENTS

| | | | |
|---|---|---|---|
| 2,999,815 | 9/1961 | Eiseman | 252/171 |
| 2,999,817 | 9/1961 | Bower | 252/172 |
| 3,539,462 | 11/1970 | Schofield | 252/364 X |
| 3,573,213 | 3/1971 | Burt | 252/172 |
| 3,692,635 | 9/1972 | Fozzard | 203/62 |
| 3,728,268 | 4/1973 | Burt | 252/170 |
| 3,789,006 | 1/1974 | McMillan et al. | 252/171 |
| 3,840,607 | 10/1974 | Hanson | 260/653 |
| 3,903,009 | 9/1975 | Bauer et al. | 252/171 |
| 4,024,086 | 5/1977 | Hutchinson | 252/364 X |
| 4,715,900 | 12/1987 | Connon et al. | 252/364 X |
| 4,767,561 | 8/1988 | Gorski | 252/364 X |

*Primary Examiner*—Brooks H. Hunt
*Assistant Examiner*—Virginia B. Caress

[57] ABSTRACT

An azeotrope or azeotrope-like composition of 1,1,2-trichloro-1,2,2-trifluoroethane (FC-113) and 1,2-dichloro-1,1-difluoroethane (FC-132b), the azeotrope being useful in solvent cleaning applications.

2 Claims, No Drawings

AZEOTRÖPE OR AZEOTROPE-LIKE COMPOSITION OF TRICHLOROTRIFLUOROETHANE AND DICHLORODIFLUOROETHANE

BACKGROUND OF THE INVENTION

Chlorocarbons and chlorofluorocarbons have obtained widespread use in recent years as specialty cleaning solvents for applications which include metal cleaning and degreasing and cleaning of printed circuit boards and instruments. Materials which are commonly used as solvents in these applications include 1,1,2-trichloro-1,2,2-trifluoroethane, trichloroethylene, tetrachloroethylene, 1,1,1-trichloroethane and an azeotrope of methylene chloride with 1,1,2-trichloro-1,2,2-trifluoroethane. For certain cleaning purposes, the 1,1,2-trichloro-1,2,2-trifluoroethane alone may have insufficient cleaning power while the chlorocarbon solvents may be too aggressive. The azeotrope of methylene chloride and 1,1,2-trichloro-1,2,2-trifluoroethane represents an ideal compromise as far as solvent power is concerned. However, increasing concerns over methylene chloride toxicity have made this solvent an unpopular choice.

At the same time that chlorocarbon toxicity concerns are increasing, modern industrial cleaning problems are becoming more complex and varied, and the requirements for the cleaning solvents are more stringent. A solvent should be low boiling, nonflammable, of low toxicity, and should exhibit a high solvent power for the residues to be removed without being so strong that it attacks the substrate being cleaned.

Desired boiling, flammability, and solvent power characteristics can often be obtained by using mixtures of solvents. However, mixtures are often unsatisfactory because they fractionate to an undesirable degree during use and recovery, making it difficult to reuse a solvent mixture with unchanged composition.

On the other hand, mixtures which exhibit azeotropic or azeotrope-like characteristics are often used because they exhibit a minimum boiling point and do not fractionate upon boiling. This is desirable because in vapor degreasing and other cleaning operations, such as circuit board cleaning in which these solvents are also useful, redistilled material is usually used. Unless the solvent mixture exhibits a constant boiling point, i.e. is an azeotrope or is azeotrope-like, fractionation will occur and cause a change in the composition of the solvent mixture during use which could result in a mixture with less desirable properties. In the case of circuit board cleaning these less desirable properties could include lower solvency for rosin fluxes, reduced inertness toward electrical components and increased flammability.

A number of fluorocarbon based azeotropic compositions have been discovered which have been tested and in some cases used as solvents for cleaning operations. For example, U.S. Pat. No. 2,999,815 discloses the azeotrope of 1,1,2-trichloro-1,2,2-trifluoroethane with acetone; U.S. Pat. No. 3,903,009 discloses a ternary azeotrope of 1,1,2-trichloro-1,2,2-trifluoroethane with nitromethane and ethanol; U.S. Pat. No. 3,573,213 discloses an azeotrope of 1,1,2-trichloro-1,2,2-trifluoroethane with nitromethane; U.S. Pat. No. 3,789,006 discloses the ternary azeotrope of 1,1,2-trichloro-1,2,2-trifluoroethane with nitromethane and isopropanol; and U.S. Pat. No. 3,728,268 discloses the ternary azeotrope of 1,1,2-trichloro-1,2,2-trifluoroethane with acetone and ethanol; and U.S. Pat. No. 2,999,817 discloses the binary azeotrope of 1,1,2-trichloro-1,2,2-trifluoroethane and methylene chloride.

Unfortunately, as recognized in the art, it is not possible to predict the formation of azeotropes and this obviously complicates the search for new azeotropic systems which have application in this field. Nevertheless, there is a constant effort in the art to discover new azeotropic or azeotrope-like systems which have desirable solvency characteristics and particularly a greater versatility of solvency power.

SUMMARY OF THE INVENTION

According to the present invention, an azeotrope or azeotrope-like composition has been discovered comprising an admixture of effective amounts of 1,1,2-trichloro-1,2,2-trifluoroethane and 1,2-dichloro-1,1-difluoroethane, and more specifically, an admixture of about 45–60 wt. percent 1,1,2-trichloro-1,2,2-trifluoroethane and about 55–40 wt. percent 1,2-dichloro-1,1-difluoroethane.

The present invention provides a nonflammable azeotrope or azeotrope-like composition which is well suited for solvent cleaning applications.

DETAILED DESCRIPTION OF THE INVENTION

The compositions of the instant invention consist of mixtures of effective amounts of 1,1,2-trichloro-1,2,2-trifluoroethane ($CCl_2FCClF_2$, boiling point 47.6° C.) and 1,2-dichloro-1,1-difluoroethane ($CClF_2CH_2Cl$, b.p. 46.4° C.). These two fluorinated materials are known as FC-113 and FC-132b, respectively, in the nomenclature conventional to the chlorofluorocarbon field.

By azeotrope or azeotrope-like is meant constant boiling liquid admixtures of two or more substances which mixtures behave like a single substance in that the vapor produced by partial evaporation or distillation has the same composition as does the liquid, i.e., the admixtures distill without a substantial change in composition. Constant boiling compositions characterized as azeotropes or azeotrope-like exhibit either a maximum or minimum boiling point as compared with that of nonazeotropic mixtures of the same substances.

By effective amount is meant the amount of each component of an admixture, which when combined will result in the formation of the azeotrope or azeotrope-like admixture of the instant invention.

It is possible to fingerprint, in effect, a constant boiling admixture, which may appear under varying guises depending on the conditions chosen, by any of several criteria:

The composition can be defined as an azeotrope of A and B, since the very term "azeotrope" is at once both definitive and limitative, requiring that effective amounts of A and B form this unique composition of matter which is a constant boiling admixture.

It is well known by those who are skilled in the art that at differing pressures, the composition of a given azeotrope will vary, at least to some degree, and changes in distillation pressures also change, at least to some degree, the distillation temperatures. Thus, an azeotrope of A and B represents a unique type of relationship but with a variable composition depending upon temperature and/or pressure. Therefore, compositional ranges, rather than fixed compositions are often used to define azeotropes.

Or, the composition can be defined as a particular weight percent relationship or mole percent relationship of A and B, while recognizing that such specific values point out only one particular such relationship and that in actuality a series of such relationships represented by A and B actually exist for a given azeotrope, varied by influence of distillative conditions of temperature and pressure.

Or, recognizing that the azeotrope A and B does represent just such a series of relationships, the azeotropic series represented by A and B can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Binary mixtures of 45–60 weight percent FC-113 and 55–40 weight percent FC-132b are characterized as an azeotrope or azeotrope-like in that mixtures within this range exhibit a substantially constant boiling point. Being substantially constant boiling, the mixtures do not tend to fractionate to any great extent upon evaporation. After evaporation, only a small difference exists between the composition of the vapor and the composition of the initial liquid phase. This difference is so small that the compositions of the vapor and liquid phases are considered substantially identical. Accordingly, any mixture within this range exhibits properties which are characteristic of a true binary azeotrope.

The binary mixture consisting of about 50.5 weight percent FC-113 and about 49.5 weight percent FC-132b with a boiling of about 44.2° C. at substantially atmospheric pressure is the preferred azeotrope or azeotrope-like composition of this invention.

The azeotropic mixtures of this invention can be used in a wide variety of solvent-cleaning applications, including vapor degreasing and metal cleaning applications and the removal of solder flux and other soils from printed circuit board assemblies. Vapor degeasers are generally used for cleaning flux and soils from printed circuit boards and metal parts. The object to be cleaned is usually passed through a sump of boiling solvent, which removes the majority of the soil; thereafter through a sump containing freshly distilled solvent at or near room temperature; and finally through solvent vapors over the boiling sump which provide a final rinse with clean pure solvent condensed on the object. The cleaning process can further comprise agitation to facilitate removal of the residues, including ultrasonic agitation of the cleaning agent or high pressure spray of the cleaning agent distillate. As an example, the azeotropic mixture of this invention can be used in cleaning processes such as is described in U.S. Pat. No. 3,881,949, which is incorporated herein by reference.

The azeotrope of this invention has several advantages over the solvents heretofore employed. Trichloroethylene, tetrachloroethylene and 1,1,1-trichloroethane are unstable and require stabilizers, whereas the azeotrope of this invention does not. In addition the azeotrope of this invention has a more favorable evaporation rate (is lower boiling) and is less aggressive toward plastics and elastomers. FC-132b is a stronger solvent than FC-113, which is often used in cleaning and degreasing operations. However, FC-132b alone may be too aggressive for some applications. Thus, the FC-113/FC132b azeotrope is particularly satisfactory for cleaning applications which require enhanced cleaning performance over FC-113 while maintaining the non-aggressive behavior of a mild solvent.

The azeotrope permits easy recovery and reuse of the solvent from vapor defluxing systems because of its azeotropic nature. In addition, FC-113 and FC-132b are nonflammable. Therefore, the azeotrope of this invention is nonflammable.

The azeotrope of the instant invention can be prepared by any convenient method including mixing or combining the desired amounts of the components. A preferred method is to weigh the desired amounts of each component and thereafter combine them in an appropriate container.

EXAMPLE 1

1,2-dichloro-1,1-difluoroethane (FC-132b) in a known amount was charged into a dry 2-neck round bottom flask fitted with a calibrated addition funnel and a reflux condenser having at its upper end a calcium sulfate drying tube and inside the condenser a calibrated thermometer suspended so as to place the bulb, wetted by condensate, in the vapor space. The FC-132b was heated to reflux by means of an electric heating mantle. From time to time 1,1,2-trichloro-1,2,2-trifluoroethane (FC-113) was added incrementally through the addition funnel. After each addition the system was allowed to equilibrate until the observed temperature of the vapor was constant. The barometric pressure was periodically recorded and the observed boiling points were corrected to 760 mm Hg pressure.

The results of the above determinations are summarized in the following table. The composition of the mixture is represented as the weight percent of FC-113 in the FC-113/FC-132b mixture. The constancy of the boiling point over the composition range of about from 45–60 weight percent FC-113 indicates the presence of the minimum boiling azeotrope. The minimum boiling point in a curve formed from these points indicates the true binary azeotrope at about 50.5 weight percent FC-113 and about 49.5 weight percent FC-132b.

TABLE

FC-113/FC-132b AZEOTROPE EXPERIMENTAL DATA

| Weight Percent FC-113 in the FC-113/FC-132b Mixture | Boiling Point °C.* |
|---|---|
| 0.00 | 46.37 |
| 10.00 | 45.56 |
| 18.18 | 45.07 |
| 25.00 | 44.76 |
| 30.77 | 44.55 |
| 35.71 | 44.39 |
| 40.00 | 44.32 |
| 43.75 | 44.27 |
| 47.06 | 44.22 |
| 49.43 | 44.21 |
| 50.00 | 44.21 |
| 50.55 | 44.20 |
| 51.08 | 44.21 |
| 51.61 | 44.21 |
| 52.12 | 44.21 |
| 52.63 | 44.21 |
| 53.61 | 44.21 |
| 54.54 | 44.22 |
| 55.44 | 44.22 |
| 56.31 | 44.23 |
| 57.14 | 44.23 |
| 59.09 | 44.24 |
| 60.87 | 44.27 |
| 64.00 | 44.33 |
| 66.66 | 44.43 |

TABLE-continued

| FC-113/FC-132b AZEOTROPE EXPERIMENTAL DATA | |
|---|---|
| Weight Percent FC-113 in the FC-113/FC-132b Mixture | Boiling Point °C.* |
| 100.00 | 47.60 |

*Corrected to 760 mm Hg presure

EXAMPLE 2

Kauri-Butanol (KB) values are often used as a measure of solvent power. The KB value for the azeotrope of this invention (50.5 wt. percent FC-113 and 49.5 wt. percent FC-132b), as measured by ASTM Method D1133-78, was determined to be 56.

We claim

1. An azeotrope comprising an admixture of about 50.5 wt. percent 1,1,2-trichloro-1,2,2-trifluoroethane and about 49.5 wt. percent 1,2-dichloro-1,1-difluoroethane.

2. The azeotrope of claim 1 further characterized by a boiling point of about 44.2° C. at 760 mm Hg.

* * * * *